United States Patent [19]

Ishizuka et al.

[11] Patent Number: 4,636,153

[45] Date of Patent: Jan. 13, 1987

[54] ROTARY COMPRESSOR WITH BLIND HOLE IN END WALL THAT ALIGNS WITH BACK PRESSURE CHAMBER

[75] Inventors: Yutaka Ishizuka; Teruo Nakamura, both of Konan, Japan

[73] Assignee: Diesel Kiki Company, Ltd., Tokyo, Japan

[21] Appl. No.: 660,773

[22] Filed: Oct. 15, 1984

[30] Foreign Application Priority Data

Oct. 18, 1983 [JP] Japan ..... 58-160916[U]

[51] Int. Cl.[4] ..... F04C 18/00

[52] U.S. Cl. ..... 418/80; 418/82; 418/268

[58] Field of Search ..... 418/259, 266–269, 418/80, 82, 93

[56] References Cited

U.S. PATENT DOCUMENTS 3,865,520 2/1975 Kramer ..... 418/82

*Primary Examiner*—Leonard E. Smith
*Assistant Examiner*—Jane E. Obee
*Attorney, Agent, or Firm*—David G. Alexander

[57] ABSTRACT

A rotary compressor has a plurality of vanes which are slidably disposed in radial slots of a rotor to define fluid chambers in cooperation with a cylindrical housing. The radially innermost end of each vane, rotor and opposite ends of the housing define a back-pressure chamber which is supplied with a pressure during a suction stroke for maintaining the associated vane in sealing contact with the inner wall of the housing. Each of opposite ends of the housing has a unique configuration which damps the pressure in the back-pressure chamber when the chamber is fluidly isolated from a source of the pressure supply during a compression stroke, thereby eliminating excessive friction between the vane and the housing.

2 Claims, 4 Drawing Figures

ROTARY COMPRESSOR WITH BLIND HOLE IN END WALL THAT ALIGNS WITH BACK PRESSURE CHAMBER

BACKGROUND OF THE INVENTION

The present invention relates to a rotary compressor for compressing desired gaseous fluid such as refrigerant and, more particularly, to an improvement in a rotary compressor of the type having a plurality of vanes mounted on a rotor.

A rotary compressor of the type described generally has a housing made up of a cylinder and a pair of side blocks mounted on axially opposite ends of the cylinder. A rotor is rotatably disposed in the housing and provided with vanes which are slidably received in substantially radially extending slots of the rotor. The nearby vanes define a fluid chamber in cooperation with the housing and rotor. During operation of the compressor, the rotor is rotated to cause the radially outermost ends of the vanes into sliding movement on the inner surface of the cylinder, thereby repeatedly increasing and decreasing the volume of the fluid chamber to compress incoming gas. The primary requisite in compressing gas in the manner described is that the outermost ends of the vanes be constantly held in sealing contact with the inner surface of the cylinder to fluidly isolate nearby fluid chambers. Such has been implemented by defining a back-pressure chamber by the radially innermost end of each vane and its associated slot and communicating a high fluid pressure to the back-pressure chamber. In operation, the pressure in the back-pressure chamber cooperates with centrifugal force developed in the vane in forcing the vane radially outwardly into sealing contact with the cylinder.

It has heretofore been customary to control the pressure P in the back-pressure chamber to a constant value as expressed by $$P=\frac{1}{2}(Pd+Ps)$$

where Pd is a delivery pressure and Ps, a suction pressure.

The problem encountered with the above prior art implementation is that during a compression stroke the pressure P becomes short to allow the vane to retract into the associated slot beyond the periphery of the rotor and, upon the subsequent suction stroke, suddently project from the slot hitting against the inner surface of the cylinder. This results in the generation of noise generally referred to as vane chattering.

To eliminate vane chattering, there has been proposed a rotary compressor of the type which makes the back-pressure chamber fluidly independent in the course of a compression stoke, as disclosed in Japanese Patent Laid-Open Publication No. 57-26293/1982, for example. Specifically, the back-pressure chamber in a compression stroke becomes an independent space so that the pressure therein may be raised against retraction of the associated vane into the slot. This type of configuration is not fully acceptable, however, since where the proportion of oil or like pressurized liquid in the back pressure chamber is substantial the vane compresses that liquid to raise the previously mentioned pressure P to an excessive level, resulting in an increase in the sliding friction between the vane and the cylinder and, therefore, a poor coefficient of performance.

SUMMARY OF THE INVENTION

It is therefore an object of the present invention to provide a rotary compressor which is capable of eliminating vane chattering without raising the pressure in a back-pressure chamber to an unusual level during a compression stroke.

It is another object of the present invention to provide a generally improved rotary compressor.

A rotary compressor of the present invention is of the type including a cylindrical housing, and a rotor rotatably disposed in the housing and provided with a plurality of vanes slidably mounted respectively in substantially radial slots which are formed in the rotor, each of the vanes defining a back-pressure chamber at an radially innermost end thereof in cooperation with the rotor and axially opposite ends of the housing. A passageway communicates a fluid pressure from a source of fluid pressure supply to the back-pressure chamber while the chamber is in a suction stroke range. The back-pressure chamber is fluidly isolated from the source of fluid pressure supply while the chamber is in a compression stroke range. A damper damps the fluid pressure in the back-pressure chamber in the compression stroke range.

In a preferred embodiment the damper comprises a blind hole formed in that surface of an end wall of the housing which faces the rotor, the back-pressure chamber aligning with the blind hole in the compression stroke range.

Preferably the passageway includes an arcuate recess formed in the surface of the end wall of the housing such that the back-pressure chamber aligns therewith in the suction stroke range.

The above and other objects, features and advantages of the present invention will become apparent from the following detailed description taken with the accompanying drawings.

DESCRIPTION OF THE PREFERRED EMBODIMENT

While the rotary compressor of the present invention is susceptible of numerous physical embodiments, depending upon the environment and requirements of use, a substantial number of the herein shown and described embodiment have been made, tested and used, and all have performed in an eminently satisfactory manner.

Figure 1:
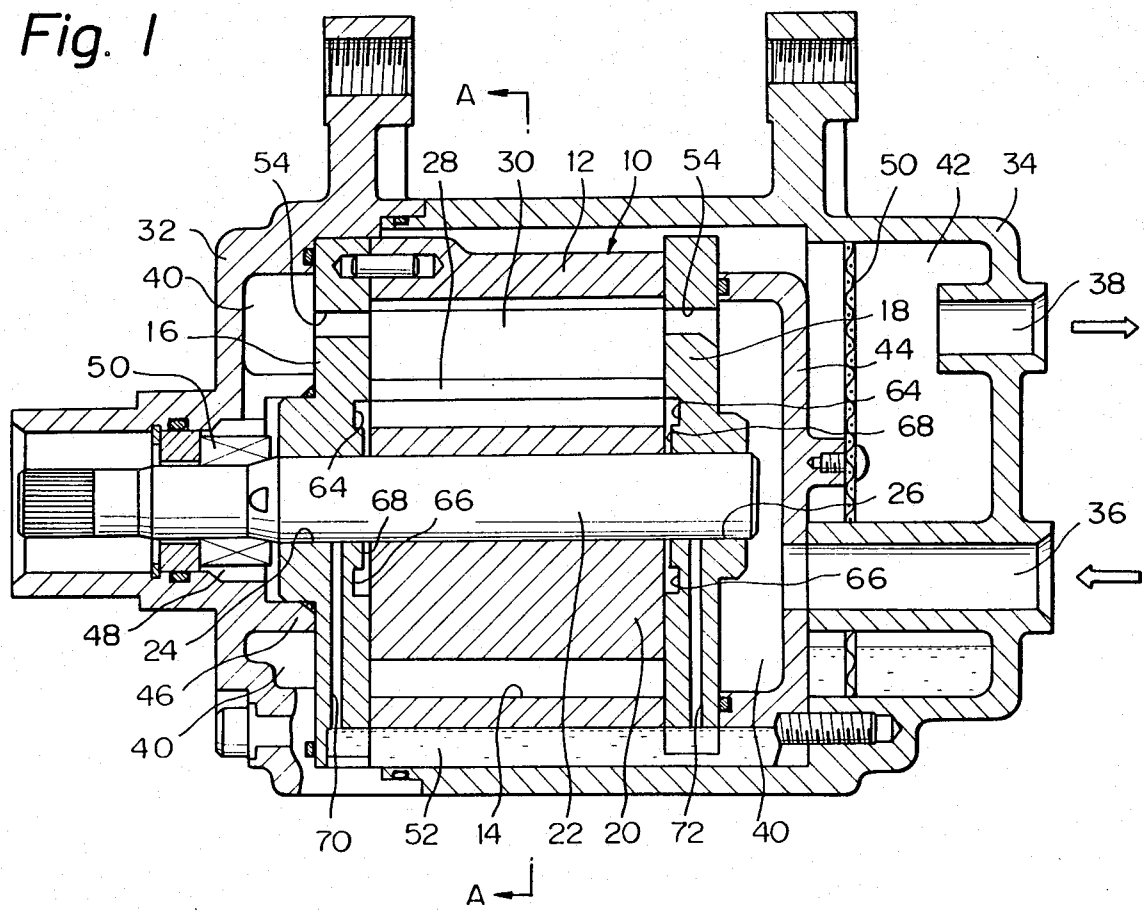
FIG. 1 is a vertical section of a rotary compressor embodying the present invention.
Figure 2:
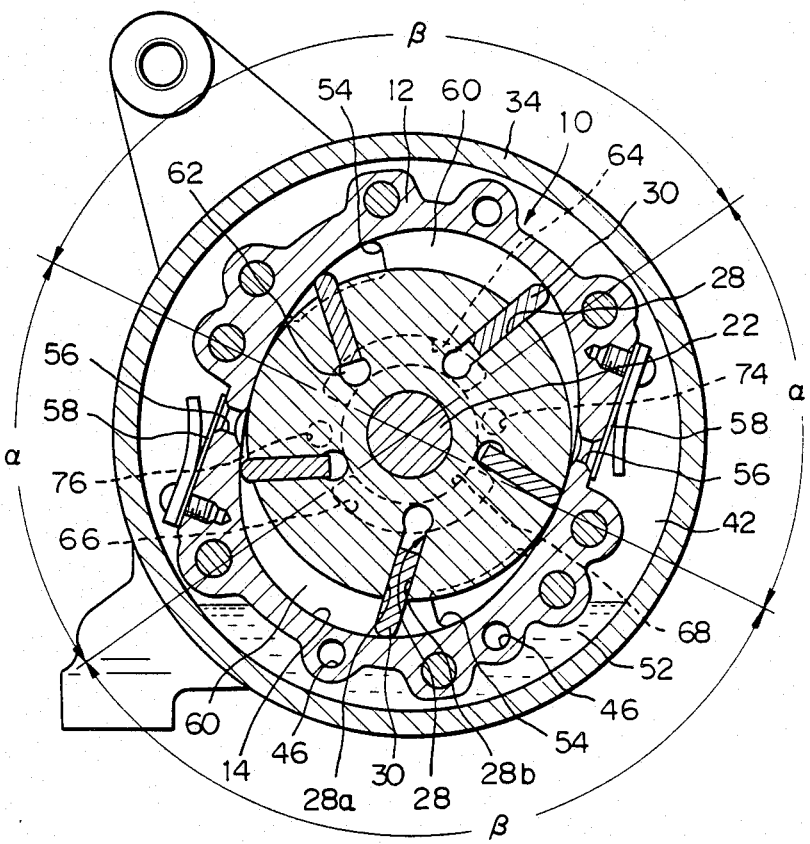
FIG. 2 is a section taken along line A—A of FIG. 1.
Figure 3:
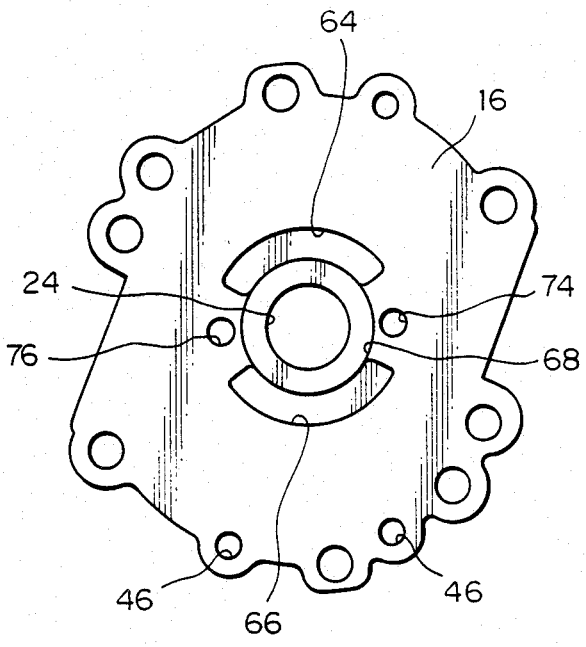
FIG. 3 is a front view of a side block included in the rotary compressor of FIG. 1.

Referring to FIGS. 1–3 of the drawings, a rotary compressor embodying the present invention comprises a housing which is generally designated by the reference numeral 10. The housing 10 includes a cylinder 12 which is formed with a bore 14 having an elliptical cross-section. The left and right ends (as viewed in FIG. 1) of the cylinder 12 are closed by side blocks 16 and 18, respectively.

A cylindrical rotor, generally 20, is disposed in the housing 10 and rigidly mounted on a drive shaft 22. The drive shaft 22 extends throghout the rotor 20 at the center of the latter and is rotatably received in bearing holes 24 and 26, which are formed through the side blocks 16 and 18, respectively. The rotor 20 contacts the inner surface of the cylinder 12 at opposite ends of the shorter axis of the ellipse each with a slight clearance. Also, the opposite ends of the rotor 20 contact the side blocks 16 and 18 each with a slight clearance. The rotor 20 is formed with substantially radially extending slots 28 at equally spaced locations along the circumference, e.g. five locations as in the illustrative embodiment. Vanes 30 are slidably mounted in the slots 28, respectively, and engage with the inner wall (not designated) of the bore 14.

The housing 10 is surrounded by a head 32 which is sealingly mounted on one of the side blocks, 16, and a shell 34 sealingly connected with the head 32. An inlet or suction passageway 36 and an outlet or delivery passageway 38 are formed through one end of of the shell 34 remote from the head 32. The inlet passageway 36 is communicated to a low pressure chamber 40, and the outlet passageway 38 to a high pressure chamber 42. A cover 44 is mounted on the side block 18 to fluidly isolate the low pressure chamber 40 from the high pressure chamber 42. Passageways 46 extend throughout the cylinder 12 and side blocks 16 and 18 to provide communication between the low pressure chamber 40 and the interior of the head 32, the latter thus constituting part of the low pressure chamber 40 and being designated by the same reference numeral 40. In the low pressure chamber 40 inside the head 32, a partition 46 extends from the head 32 to define a seal chamber 48. A sealing device 50 is disposed in the seal chamber 48 and interposed between the head 32 and the drive shaft 22 which protrudes from the side block 16, thereby maintaining the low pressure chamber 40 fluid-tight from the ambience.

The high pressure chamber 42 is defined by the housing 10 and the shell 34. An oil separator 50 is positioned in the chamber 42, while an oil reservoir or sump 52 is defined in a lower portion of the chamber 42.

The low pressure chamber 40 is communicated to the bore 14 of the housing 10 by inlet openings 54 formed through the side blocks 16 and 18, and the high pressure chamber 42 by outlet openings 56 formed through the circumferential wall of the cylinder 12. In each of the side blocks 16 and 18, two inlet openings 54 are located at an angular spacing of substantially 180 degrees for each other. The outlet openings 56 are located in positions where the cylinder 12 is engaged by the rotor 20, and each is closed by a reed type delivery valve 58. As shown in FIG. 2, the vanes 30 in conjunction with the rotor 20 and the inner wall of the bore 14 define fluid chambers 60. The outlet passageways 56 are controlled by the check valves 58 into alternate communication with the fluid chambers 60. While the rotor 5 is in rotation, the vanes 30 are pressed against the inner wall of the bore 14 by centrifugal force developed therein and back pressure communicated to back-pressure chambers 62, thereby sealing the nearby fluid chambers 60 from each other.

Each back-pressure chamber 62 is defined in the innermost end of the slot 28 by the rotor 20, vane 30 and side blocks 16 and 18. The pressure developing in the chamber 62 is adjusted by a back-pressure adjusting arrangement which will be described.

The back-pressure adjusting arrangement is associated with each of the side blocks 16 and 18. For the construction of the adjusting arrangement, as shown in FIG. 2, the locus along which each end of the back-pressure chamber 62 moves on the side block 16 or 18 (circular locus in the illustrative embodiment) is divided into alternating high pressure sections $\alpha$ and normal pressure sections $\beta$ in the circumferential direction. Each high pressure section $\alpha$, briefly stated, covers an angular range in which any of the vanes 30 is positioned at and in the vicinity of the outlet opening 56. Specifically, the high-pressure section $\alpha$ extends from the position where the rear end of the back-pressure chamber 62 with respect to the direction of rotation of the rotor 20 is located when an imaginary extension of a leading side 28*a* of the slot 28 with respect to the same direction assumes a position just before the port of the outlet opening 56, to the position where the front end of the chamber 62 is located when a trailing side 28*b* of the slot 28 assumes a position just after the point of contact between the cylinder 12 and the rotor 20. The normal pressure sections $\beta$ cover the rest of the locus.

Arcuate grooves 64 and 66, for example, extend from one end to the other end of the respective normal pressure sections $\beta$ in that surface of each of the side blocks 16 and 18 which faces the rotor 20. The grooves 64 and 66 in each side block 16 or 18 communicate to the bearing hole 24 or 26 via an annular recess 68 which is located radially inwardly of the grooves. A passageway 70 extends through the side block 16, and a passageway 72 through the side block 18. Each of these passageways 70 and 72 provides communication between the associated bearing hole 24 or 26 and the oil sump 52. In this construction, fluid, which is oil in this particular embodiment, is communicated from the sump 52 to the grooves 64 and 66 of each side block 16 or 18 by way of the passageway 70 or 72 while being restricted by the clearance between the drive shaft 22 and the bearing hole 24 or 26. Further, the side blocks 16 and 18 are each provided with blind holes 74 and 76 on their surfaces adjacent to the rotor 20 and in positions which lie in the previously mentioned high pressure sections $\alpha$ where compression strokes are effected.

In each normal pressure section $\beta$, therefore, the back-pressure chamber 62 will face any of the grooves 64 and 66 at opposite ends thereof and over its whole sectional area so that the pressure of the oil in the grooves is directly admitted into the chamber 62. Meanwhile, in the high pressure section $\alpha$, the chamber 62 will be fluidly isolated from the grooves 64 or 66 by that part of each side block which intervenes between the grooves 64 and 66 and brought into alignment with the blind holes 74 or 76 instead, so that the pressure in the chamber 62 is released, or damped, into the blind holes while being confined in the chamber and the blind holes.

In the illustrative embodiment, the blind holes 74 and 76 are each positioned substantially at the center between the two grooves 64 and 66 and provied with a circular shape. In practice, however, their position, shape and size will be suitably determined depending upon the specific pressure variation characteristic in the back-pressure chambers 62.

The rotary compressor having the above-described construction will be operated as follows.

When the drive shaft 22 is rotated, it causes the rotor 20 to rotate together with the vanes 30. As any of the fluid chambers 60 defined by nearby vanes 30 increases in volume, it sucks gas thereinto via the inlet passageways 54. Then, while decreasing in volume, the fluid chamber 60 compresses the gas and delivers it to the high pressure chamber 42 via the delivery opening 56 forcing the delivery valve 58 to open. Such suction and compression strokes are repeated to compress the incoming gas. The compressed gas is temporarily retained in the high pressure chamber 42 to raise the pressure therein. As a result, the oil in the oil sump 52 is pumped into the bearing holes 24 and 26 via the passageways 70 and 72, respectively. The oil in the bearing holes 24 and 26 are communicated to the grooves 64 and 66 except for part thereof which is admitted into the seal chamber 48, while being restricted by the clearance between the drive shaft 22 and the bearing holes 24 and 26.

Figure 4:
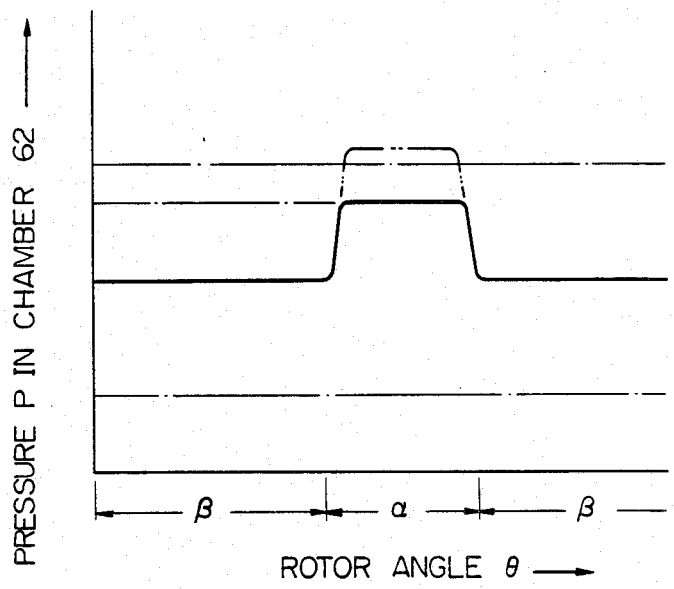
FIG. 4 is a graph showing the advantage of the present invention over the prior art with respect to pressure variation in a back-pressure chamber.

While the back-pressure chamber 60 is in the normal pressure section $\beta$, its opposite ends are held in communication with the grooves 64 or 66 so that the oil in those grooves and, therefore, its pressure is admitted into the chamber 62. Also, the chamber 62 is held in communication with the chamber 60 via the clearance between the vane 30, rotor 20 and the like. Hence, as shown in FIG. 4, the pressure $P_1$ in the chamber 62 is controlled substantially to $\frac{1}{2}$ (Pd+Ps) where Pd and Ps designate respectively a delivery pressure a suction pressure, as previously stated.

Thereafter, as the front end of the back-pressure chamber 62 with respect to the direction of rotation begins to enter the high pressure section $\alpha$, the area of the chamber 62 overlapping with the grooves 64 or 66 gradually decreases. When the rear end of the chamber 62 has entered the high pressure section $\alpha$, the chamber 62 becomes completely isolated from the grooves 64 or 66 and, at the same time, the vane 30 is gradually forced to retract into the slot 28 due to the configuration of the bore 14. Therefore, the volume of the chamber 62 is reduced tending to sharply raise the pressure in the chamber 62. However, since the chamber 62 has then been aligned with the blind holes 74 or 76 to release the pressure therefrom into the latter, the pressure in the chamber 62 does not rise in the manner indicated by a dash-and-dots line in FIG. 4 and, instead, remains at a predetermined level $P_2$ as indicated by a solid line.

In summary, it will be seen that the present invention provices a rotary compressor which prevents the pressure in back-pressure chambers in compression strokes from being raised to an unusual level and, thereby, confines the sliding friction of the outermost ends of vanes in an allowable range to attain a desirable result coefficient. In addition, the back-pressure chambers can be depressurized in a rapid and accurate manner.

Various modifications will become possible for those skilled in the art after receiving the teachings of the present disclosure without departing from the scope thereof.

What is claimed is:

1. In a rotary compressor including a cylindrical housing, and a rotor rotatably disposed in the housing and provided with a plurality of vanes slidably mounted respectively in substantially radial slots which are formed in the rotor, each of the vanes defining a back-pressure chamber at a radially innermost end thereof in cooperation with the rotor and axially opposite ends of the housing, the improvement comprising:

passageway means for communicating a fluid pressure from a source of fluid pressure supply to the back-pressure chamber while the chamber is in a suction stroke range;

means for fluidly isolating the back-pressure chamber from the source of fluid pressure supply while the chamber is in a compression stroke range; and damper means for damping the fluid pressure in the back-pressure chamber in said compression stroke range;

the damper means comprising a blind hole formed in that surface of an end wall of the housing which faces the rotor, the back-pressure chamber aligning with said blind hole in the compression stroke range.

2. The improvement as claimed in claim 1, wherein the passageway means includes an arcuate recess formed in said surface of said end wall of the housing such that the back-pressure chamber aligns therewith in the suction stroke range.

* * * * *